United States Patent [19]

Matsuo et al.

[11] Patent Number: 4,560,634

[45] Date of Patent: Dec. 24, 1985

[54] ELECTROPHOTOGRAPHIC PHOTOSENSITIVE MEMBER USING MICROCRYSTALLINE SILICON

[75] Inventors: Takeshi Matsuo, Yokosuka; Yukio Suzuki, Ayase, both of Japan

[73] Assignee: Tokyo Shibaura Denki Kabushiki Kaisha, Kawasaki, Japan

[21] Appl. No.: 382,285

[22] Filed: May 26, 1982

[30] Foreign Application Priority Data

May 29, 1981 [JP] Japan ..... 56-80743
May 29, 1981 [JP] Japan ..... 56-80745

[51] Int. Cl.[4] ..... G03G 5/08

[52] U.S. Cl. ..... 430/84; 430/66; 430/95; 430/128; 427/39

[58] Field of Search ..... 427/74, 39; 430/64, 430/65, 67, 84, 95, 135, 66, 128

[56] References Cited

U.S. PATENT DOCUMENTS

| | | | |
|---|---|---|---|
| 4,004,954 | 1/1977 | Tshudy et al. | 427/86 |
| 4,225,222 | 9/1980 | Kempter . | |
| 4,253,882 | 3/1981 | Dalal | 427/74 |
| 4,265,991 | 5/1981 | Hirai et al. | 430/64 |
| 4,420,546 | 12/1983 | Kanbe et al. | 430/57 |

FOREIGN PATENT DOCUMENTS 3134189 4/1982 Fed. Rep. of Germany .

OTHER PUBLICATIONS

Uchida et al., Journal de Physique pp. C4-265-268 10/81.

Y. Mishimi et al., Japanese Journal of Applied Physics, 20 LIZI (1980).

Hamasaki et al., Appl. Phys. Lett. 37 (12), pp. 1084, 1085, 1086, Dec. 15, 1980.

Y. Imai et al., Annual Meeting of the Japanese Soc. of Appl. Phys., 7a-A-4, Oct. 1977.

European Search Report, IBM Technical Disclosure Bulletin, vol. 21, No. 11, Apr. 1979, p. 4691, New York, USA, R. Tsu et al.: "New Type of Thin Film Hybrid Crystalline-Amorphous Si Solar Cell with High Light Absorption P-I-N Structure".

Patents Abstracts of Japan, vol. 6, No. 38(P-105)(916), Mar. 9, 1982, Tokyo, Japan & JP-A-56 155 945, Shibaura Denki K.K., 2/12/81.

J. Electrochem. Soc.: Solid-State Science and Technology; vol. 122, No. 5, pp. 701-706 (May 1975) Seto.

J. Electrochem. Soc.: Solid-State Science and Technology; vol. 120, No. 12, pp. 1761-1766 (Dec. 1973) Rai--Choudhury et al.

*Primary Examiner*—John L. Goodrow

*Attorney, Agent, or Firm*—Schwartz, Jeffery, Schwaab, Mack, Blumenthal & Evans

[57] ABSTRACT

An electrophotographic photosensitive member constituted of an electroconductive supporting substrate and a photoconductive layer provided on said substrate, said photoconductive layer being composed primarily of a microcrystalline silicon or a layered product of a microcrystalline silicon and an amorphous silicon.

21 Claims, 4 Drawing Figures

ELECTROPHOTOGRAPHIC PHOTOSENSITIVE MEMBER USING MICROCRYSTALLINE SILICON

BACKGROUND OF THE INVENTION

This invention relates to an electrophotographic photosensitive member, more particularly to a high sensitivity electrophotographic photosensitive member comprising a photoconductive layer composed primarily of a microcrystalline silicon.

As the materials constituting photoconductive layers of electrophotographic photosensitive members of the prior art, there have been known inorganic materials such as CdS, ZnO, Se, Se-Te, amorphous silicon (a-Si) and the like and organic materials such as poly-N-vinylcarbazole (PVCz), trinitrofluorenone (TNF) and the like. However, these photoconductive materials involve various problems as materials to be used in practical application and under the present circumstances these materials have been used in various applications depending on the situations, more or less at the sacrifice of the characteristics of the system. For example, Se and CdS are materials which are essentially harmful to human bodies and therefore it is required to have a particular concern about safety in preparation of these. For this reason, the production device tends to be complicated, requiring a superfluous expenditure for preparation thereof. It is also required to recover such a material as Se and the expense necessary for such a recovery will be reflected in the material cost. As for characteristics, in case of, for example, Se (or Se-Te system), the crystallization temperature is as low as 65° C. and therefore crystallization may occur during repeated copying, thereby tending to cause practical problems with respect to residual images or others and resulting ultimately in the drawback of short life. On the other hand, in case of ZnO, physical properties of the material are susceptible of oxidation and reduction, thus tending to be markedly influenced by the environmental atmosphere, and hence it has the problem of lower reliability. Further, in case of organic photoconductive members, PVC and TNF have recently been questioned about their possibility as carcinogens and therefore it is quite probable that there may be invited the situation to prohibit production of these materials. Besides, since they are organic materials, they suffer from poor thermal stability and weak abrasion resistance, having thus the drawback of shorter product life.

Meanwhile, an amorphous silicon (a-Si) has recently attracted attention as an inorganic material, and there are so many attempts to utilize such a material for a solar cell as well as various investigations about other applications such as a photoconductive material for an electrophotographic photosensitive member. Such an amorphous silicon material has the advantages as an electrophotographic photosensitive member which are deficient in other materials as mentioned above. That is, (1) it is a non-polluting material; (2) it has a better photosensitivity to the light in the longer wavelength region than the materials of the prior art; and (3) it has a high surface hardness and excellent in abrasion resistance. On account of such advantages, it is greatly expected to be applicable for an electrophotographic photosensitive member (see U.S. Pat. Nos. 4,225,222 and 4,265,991).

However, the amorphous silicon layer can be formed at a very small rate so that it takes a very long period of time to produce a drum, whereby productivity is disadvantageously low as pointed out in the art (see for example Japanese Provisional Patent Publication No. 86341/1979). That is, an amorphous silicon is generally formed according to the high frequency glow discharge decomposition method using silanes as the starting material, but the film forming rate is remarkably small on the order of 4 Å/sec, and for example, the reaction time as long as 13 hours or more is required for formation of an amorphous silicon with a thickness of about 20 μm. It is therefore indeed necessary to enhance greatly the film forming rate for the purpose of realizing commercial application of an amorphous silicon for a photoconductive member of an electrophotographic photosensitive member. However, when it is intended to accelerate the film forming rate of an amorphous silicon, the resultant film will be predominated by the binding structures such as $(SiH_2)_n$, $SiH_3$, etc. as apparently seen from IR absorption spectrum thereof. Further, due to higher content of voids, silicon dangling bonding will be increased. As the result, photoconductivity is worsened to make the product difficultly available as an electrophotographic photosensitive member. For this reason, the film forming rate of an amorphous silicon layer is limited to 10 Å/sec at the highest, generally about 4 Å/sec as mentioned above. But such a low film forming rate is now a great drawback in industrial application, since it will bring about low productivity which may be one factor leading to increase in cost of the product drum. Also, a long wavelength photosensitive member corresponding to a semiconductor laser light source may be photosensitive to the wavelength region up to approximately 850 nm, but an amorphous silicon has the drawback that it has no sufficient sensitivity in the long wavelength region due to the relation to its light absorption coefficient.

SUMMARY OF THE INVENTION

The object of the present invention is to develop a novel photosensitive layer as an alternative for the electrophotographic photosensitive members of the prior art and thereby to provide an electrophotographic photosensitive member which is strong in mechanical strength and excellent in abrasion resistance, being safe without fear of causing pollution and having additional advantages of greater rate in preparation than in preparation of a photosensitive member having a photoconductive layer constituted only of an amorphous silicon and of high sensitivity even to the long wavelength region.

That is, the electrophotographic photosensitive member according to the present invention comprises an electroconductive supporting substrate and a photoconductive layer provided on said supporting substrate, characterized in that said photoconductive layer is constituted primarily of a microcrystalline silicon. In another embodiment of the electrophotographic photosensitive member according to the present invention, the photoconductive layer may be a layered product constituted of a microcrystalline silicon layer and an amorphous silicon layer.

DETAILED DESCRIPTION OF PREFERRED EMBODIMENTS

Figure 1:
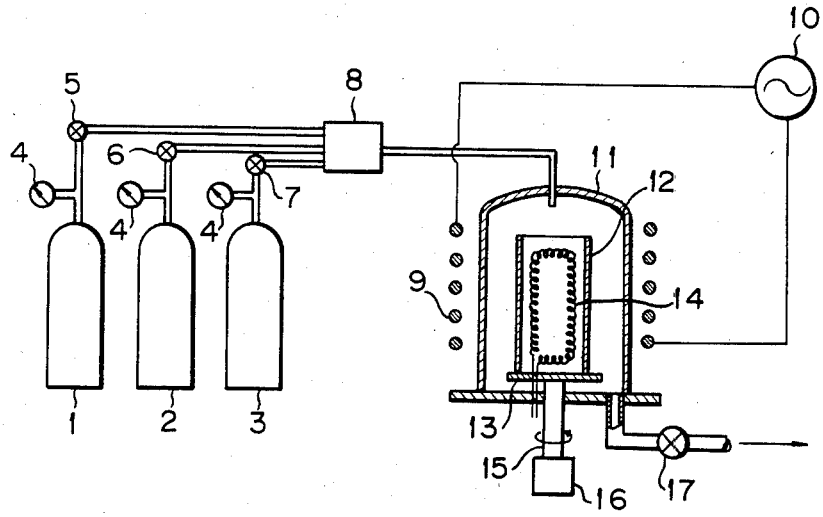
FIG. 1 shows an example of a device for preparation of the electrophotographic photosensitive member of the present invention.

The microcrystalline silicon used in the present invention is characterized in the following respects and can clearly be distinguished from an amorphous silicon or a polycrystalline silicon. That is, according to X-ray diffraction, no diffraction pattern can be recognized in an amorphous silicon which is amorphous, while a microcrystalline silicon exhibits a crystal diffraction pattern at 27°. Also, a polycrystalline silicon has a specific dark resistance of $10^6$ ohm.cm or less, while a microcrystalline silicon a specific dark resistance of $10^{11}$ ohm.cm or more. Such a microcrystalline silicon may be considered to be constituted of microcrystals with particle sizes of about several ten angstroms.

The photoconductive layer constituting the electrophotographic photosensitive member according to the present invention, which comprises primarily a microcrystalline silicon, may have a layer thickness within the range of from 2 to 100 μm, preferably from 10 to 20 μm.

Also, in case of a photoconductive layer consisting of a microcrystalline silicon layer and an amorphous silicon layer, the layer thickness may preferably be 2 to 100 μm, more preferably 10 to 20 μm. In this case, the microcrystalline silicon layer and the amorphous silicon layer may be layered in any desired order, but it is preferred that the microcrystalline silicon layer may be an upper layer from standpoint of photosensitivity and static charge retentivity. When a photoconductive layer is to be formed by layering of the two layers, the ratio of the layer thickness of the lower layer to that of the upper layer may preferably be about 0.01–0.5:1, more preferably about 0.1–0.5:1.

For preparation of the electrophotographic photosensitive member according to the present invention, a microcrystalline silicon layer or a microcrystalline silicon layer and an amorphous silicon layer may be deposited on an electroconductive supporting substrate according to such a method as the high frequency glow discharge decomposition method.

For formation of a microcrystalline silicon layer, there may be adopted the high frequency glow discharge decomposition method or the reactive sputtering method, and its film conditions may be selected as described below. That is, in case of the high frequency glow discharge decomposition method, glow discharging may be effected in the presence of a starting gas such as silane ($SiH_4$) gas, disilane ($Si_2H_6$) gas, etc., under the conditions of a supporting substrate temperature of 300° to 350° C., preferably 320° to 350° C., and a power density of 0.5 to 5 W/cm$^2$, preferably 1 to 3 W/cm$^2$. The gas pressure during this operation may preferably be 0.01 to 10 Torr, more preferably 0.02 to 0.2 Torr, and the starting gas may be fed preferably at a rate of 100 to 1000 cc/min.

According to the sputtering method a high frequency sputtering (for example, 13.56 MHz) can be effected in a hydrogen stream using silicon as the target to form a film on the supporting substrate. That is, a silicon crystal is fixed on a target electrode and the reactive sputtering device is evacuated internally to about $1\times10^{-8}$ to $1\times10^{-6}$ Torr. As the next step, using a gas such as hydrogen, argon, nitrogen, oxygen, etc., as a discharging gas and controlling the gas pressure at about 0.1 to 1 Torr, a high frequency voltage of about 4 to 13.56 MHz is applied to effect sputtering, whereby a microcrystalline silicon layer can be formed.

According to the method as described above, a microcrystalline silicon layer can be formed at a great rate of about 50 to 100 Å/sec and yet there is not observed lowering in photoconductive characteristics at all, but there can be obtained a photoconductive layer having excellent performance.

An amorphous silicon layer may also be formed according to the high frequency glow discharge decomposition method. Its film forming conditions may be similar to those as in formation of a microcrystalline silicon layer, namely in the presence of a starting gas such as silane gas, etc., at a supporting substrate temperature of 200° to 300° C., preferably 200° to 250° C., and a power density of 0.1 to 0.5 W/cm$^2$. The gas pressure during this operation may preferably be 0.01 to 2 Torr, more preferably 0.1 to 0.5 Torr, and the starting gas may be fed preferably at about 100 to 500 cc/min.

The electrophotographic photosensitive member of the present invention, since it can be prepared in a preparation device of a closed system similarly as single layer of an amorphous layer of the prior art, is safe and its product harmless to human bodies. Moreover, since it is excellent in heat resistance, humidity resistance and abrasion resistance, it is provided with the advantages of elongated life without deterioration even after repeated uses for a long term of period. However, the greatest advantage of the electrophotographic photosensitive member of the present invention resides in greater film forming rate of the photoconductive layer consisting of a microcrystalline silicon which enables markedly high industrial productivity. By such an advantage, the barriers in industrial application of the member of the prior art using only an amorphous silicon can be overcome and therefore the significance of the present invention is very great.

The photoconductive layer in the present invention may preferably be doped with small amounts of other elements (dopants) than silicon. As the elements for such doping, there may be mentioned, for example, hydrogen, oxygen, nitrogen, carbon, the elements of the Group III A of the periodic table, the elements of the Group V A of the periodic table.

Among them, when hydrogen is doped in the photoconductive layer, the photoconductive layer characteristics can particularly preferably be further enhanced through well-balanced dark resistance and photocurrent/dark current ratio. In this case, the amount of hydrogen to be doped may preferably be 5 to 30 atomic %, more preferably 10 to 20 atomic %. At a hydrogen content less than 5 atomic %, voids in the photoconductive layer may be increased so much that dark resistance may be lowered, while an amount in excess of 30 atomic % cannot afford a desirable photosensitivity.

Doping of hydrogen into a photoconductive layer may be conducted according to, for example, the high frequency glow discharge decomposition method, by introducing a silane such as $SiH_4$ or $Si_2H_6$ as starting material together with a hydrogen gas as carrier into a reaction chamber, wherein glow discharging may be effected. In another example, there may also be employed a gas mixture of a silicon halide such as $SiF_4$, $SiCl_4$, etc. with hydrogen as the starting material, or alternatively the reaction may also be carried out in a gas mixture system of a silane with a silicon halide to provide similarly a microcrystalline silicon containing hydrogen. As a general tendency, it is necessary to increase the substrate temperature higher (about 300° to 350° C.) when a silicon halide is used as the starting gas.

Next, the dopants to be doped into a photoconductive layer have the function to make the photoconductive layer p-type or n-type semiconductor. In order to make the photoconductive layer p-type, it is suitable to use an element of the Group III A of the periodic table such as B, Al, Ga, In, Tl, etc., especially preferably B. Doping of these elements may be effected by use of a gas such as diborane ($B_2H_6$) or trimethylaluminum (Al $(CH_3)_3$) in the same manner as in doping of hydrogen. The content of these dopants, which may suitably be determined depending on the electric characteristics, is generally preferred to be within the range of $10^{-6}$ to $10^{-4}$ atomic %, more preferably $10^{-5}$ to $10^{-4}$ atomic %. For the purpose of doping the dopant in an amount within the range as specified above, the gas ratio in the starting gas may preferably be controlled to 1 to 100 ppm, more preferably 10 to 100 ppm at the time of high frequency glow discharge decomposition. On the other hand, in order to make a photoconductive layer n-type, it is suitable to use an element of the Group V A of the periodic table such as N, P, As, Sb, Bi, etc., especially preferably N or P. Doping of these elements may be effected by use of a gas such as ammonia ($NH_3$), phosphine ($PH_3$), etc., also in the same manner as in doping of hydrogen. The content of these dopants is preferred to be within the range of $10^{-5}$ to $10^{-2}$ atomic %, more preferably $10^{-5}$ to $10^{-4}$ atomic %. For the purpose of doping the dopant in an amount within the range as specified above, the gas ratio in the starting gas may preferably be controlled to 10 to 10000 ppm, more preferably 10 to 100 ppm and fed at a rate of 100 to 1000 cc/min. at the time of high frequency glow discharging decomposition.

Further, for the purpose of increasing the dark resistance of the photoconductive layer to enhance the photoconductive characteristics thereof, it is desirable to dope at least one kind selected from the group consisting of nitrogen, oxygen and carbon. These dopings may also be conducted in the same manner as in doping of hydrogen, and it is preferred to use a gas such as ammonia ($NH_3$), oxygen ($O_2$), methane ($CH_4$), etc. Preferable amounts of these dopants may range from about $10^{-4}$ to $10^{-3}$ atomic %. For doping in amounts within the range as specified above, it is preferred to control the gas content in the starting gas to 100 to 1000 ppm.

These elements are believed to be precipitated at the grain boundaries of microcrystalline silicon or amorphous silicon or act as terminators of the dangling bonds of silicon, thereby reducing the density of states existing in the forbidden band between bands to afford the aforesaid effect.

In carrying out doping, without recourse to the high frequency glow discharging decomposition method, there may of course be employed a physical method such as sputtering, etc., to effect successfully doping.

The microcrystalline silicon layer has a relatively large refractive index of about 3 and hence light reflection on the surface is liable to occur, as compared with the photoconductive layer of the prior art such as Se. For this reason, the quantity of light to be absorbed in the photoconductive layer will be lowered in proportion to increase optical loss percentage. Thus, it is preferred to provide a reflection prevention layer on the surface. Such a reflection prevention layer may have a thickness preferably of 0.1 to 5 μm, more preferably 0.2 to 0.5 μm.

For the purpose of protecting the photoconductive layer, the photosensitive member may preferably be provided with a surface protective film. Such a surface protective film may have a thickness preferably of 0.1 to 5 μm, more preferably 0.2 to 0.5 μm.

The above reflection layer and surface protective film can be made preferably by use of a material having both of the performances for convenience in preparation. As such a material for surface coating layer, there may be employed, for example, inorganic compounds such as $Si_3N_4$, $SiO_2$, $Al_2O_3$, etc., or organic materials such as polyvinyl chloride, polyamide, etc.

The electroconductive substrate to be used in the present invention is not particularly limited, but there may be employed stainless steel, aluminum or a glass coated with an indium tin oxide (ITO) film, which may be shaped in any desired form such as film, sheet, drum, belt, and so on.

As described above, the present invention was successful in enabling a high speed production of a long wavelength photosensitive member, which is sensitive even to a semiconductor laser, using a microcrystalline silicon type material and an amorphous silicon type material.

Referring now to FIG. 1 showing a schematic illustration of an example of the device to be used for practice of the present invention, the steps for preparation of the electrophotographic photosensitive member of the present invention are to be described below.

In FIG. 1, the numerals 1, 2 and 3 are bombs for the reaction gases containing, for example, $SiH_4$, $B_2H_6$, $O_2$, etc., as starting gases. The numeral 4 indicates pressure controllers, each being capable of setting the flow amount through the valves 5,6 and 7, respectively. Further, 8 is a mixer of gases, in which the reaction gases are to be thoroughly mixed. The numeral 9 is a work coil, 10 a power source for high frequency voltage 11 a reaction chamber, 12 a drum substrate, 13 a support for the drum substrate, 14 a heater, 15 a a rotary axis of the drum substrate, 16 a driving motor for rotation of the drum, and 17 a connection gate valve to an evacuation system for obtaining vacuum necessary for effecting glow discharging.

For example, under the conditions shown below, a microcrystalline silicon layer is formed. After the drum substrate 12 is mounted in the reaction chamber 11, the chamber is evacuated to about less than 0.1 Torr by actuation of the evacuation system and then the required reaction gases from the bombs 1 through 3 mixed at any desired ratio are introduced into the reaction chamber 11 to set the pressure therein at 0.3 to 1.0 Torr. As the next step, while rotating the drum substrate by means of the rotary driving motor 16, glow discharging is effected by supplying electric power from the high frequency power source 10 thereby to deposit a microcrystalline silicon on the drum substrate. In this case, it is also possible to form a thin film while under heating by provision of a mechanism for heating the substrate. The bomb 3 may also contain a starting gas as a source for supplying oxygen, nitrogen or carbon such as $N_2O$, $NH_3$, $NO_2$, $CH_4$ or $C_2H_6$ in order to incorporate such elements in a microcrystalline silicon layer.

The present invention is described in further detail by referring to the following Examples.

EXAMPLE 1

Using a device as shown in FIG. 1, an electrophotographic photosensitive member was prepared in the following manner. An aluminum drum substrate having a size of 1.5 mm in thickness, 80 mm in diameter and 200 mm in length, which had been prepared by application of a surface treatment with a weak acid on its surface, followed by thorough washing with water and drying, was mounted on the supporting stand 13 in the reaction chamber 11 for glow discharge. As the next step, the valve 17 was opened to evacuate the air in the reaction chamber to a vacuum degree of about $10^{-6}$ Torr. Then, the power source for the heater 14 was turned on to heat evenly the aluminum drum substrate to a temperature of 360° C., at which the temperature was thereafter maintained. Subsequently, the drum was rotated by means of the driving motor 16 at a rotation speed of 20 r.p.m, followed by opening of the pressure reduction valve 4 to permit the $SiH_4$ gas from the bomb 1 while controlling its flow by the controlling valve 5 to flow into the reaction chamber 11. The pressure in the reaction chamber 11 was thereby adjusted to 1.0 Torr. Subsequently, the high frequency power source 10 was turned on to input a power of 2 KW with a frequency of 13.56 MHz. Thus, discharging was excited to form a microcrystalline silicon layer on the aluminum substrate. The microcrystalline silicon layer was thereby formed at a rate of about 0.5 μm/min. and there was obtained a thickness of about 20 μm by effecting the glow discharging for about 40 minutes. After completion of the glow discharge formation, the valve 5 was closed and the reaction chamber was made atmospheric through leak of nitrogen gas into the reaction chamber and the high frequency power source and other input power sources were turned off, followed by taking out of the drum.

Figure 2:
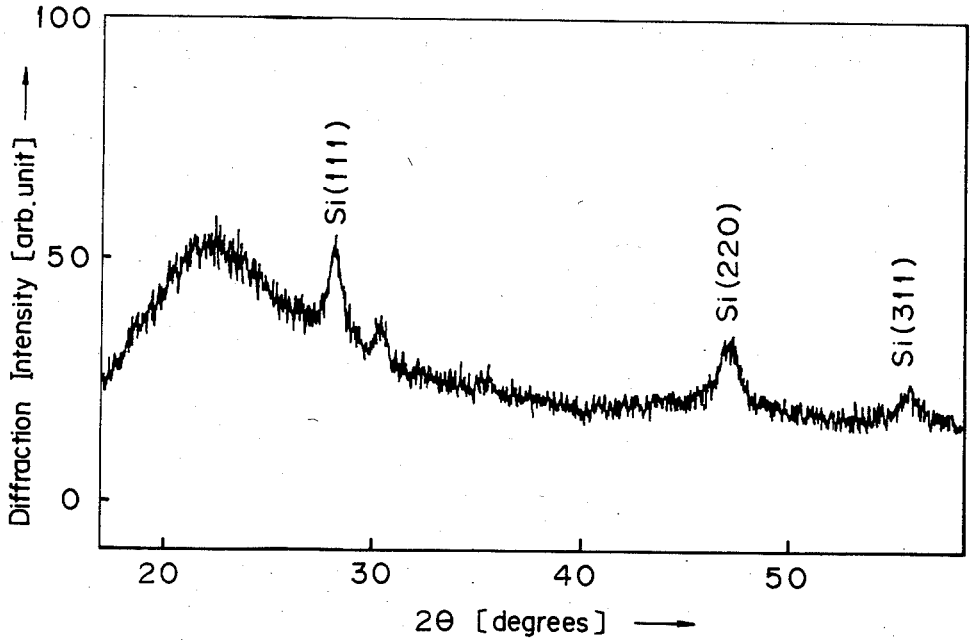
FIG. 2 is an X-ray diffraction pattern of the photoconductive layer prepared in Example 1.

The microcrystalline silicon layer prepared according to the above method was analyzed by the X-ray diffraction method. The results are shown in FIG. 2, from which it can clearly been seen that a microcrystalline silicon is formed.

Particles sizes of the crystalline of the microcrystalline silicon layers was calculated from the X-ray diffraction data according to the following equation:

$$D = \frac{0.9\,\lambda}{B_0 \cdot \cos\theta_0}$$

[wherein λ represents wavelength of the incident X-ray; $B_0$ represents a value calculated from the formula: $\pi/180\sqrt{(\Delta 2\theta_0)^2-(\Delta 2\theta_{std.})^2}$ (in which $\Delta 2\theta_0$ is a half width value obtained from the data in FIG. 2 and $\Delta 2\theta_{std.}$ is a half width value of the case where Si is used); and $\theta_0$ represents a diffraction angle.]

As the results of calculation, it was found that the particle size of the microcrystalline silicon was 71.5 Å.

Then, corona discharging at a voltage of 6 KV was applied in the darkness on the microcrystalline silicon surface of the thus prepared electrophotographic photosensitive member, followed by imagewise exposure at a dose of 13 lux.sec to form an electrostatic image, which was in turn subjected to fixing according to the Carlson process. As the result, there could be obtained a clear image which was excellent in gradation and high in resolution. Further, for examination of reproducibility and stability of this transfer process, copying operations were repeated, whereby it was found that the transferred image after copying 100,000 sheets was also extremely good. Thus, the electrophotographic photosensitive member using the microcrystalline silicon proved to be excellent in durability such as corona resistance, abrasion resistance and others.

COMPARATIVE EXAMPLE

Figure 3:
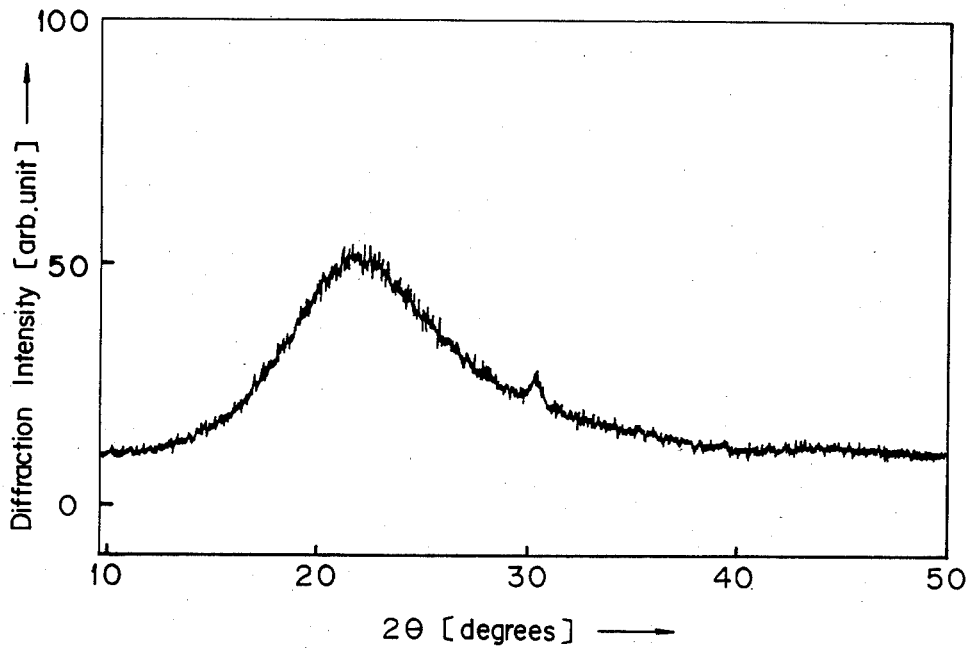
FIG. 3 is an X-ray diffraction pattern of the amorphous silicon layer.

For comparison, an amorphous silicon layer was analyzed by the X-ray diffraction method similarly as in Example 1. The results are shown in FIG. 3.

EXAMPLE 2

Example 1 was repeated, except that in this Example $B_2H_6$ gas from the bomb 2 was also introduced as the reaction gas in addition to $SiH_4$ while being controlled by the flow amount controlling valve 6 into the reaction chamber 11, thereby to obtain a p-type microcrystalline silicon layer. Evaluation of the product conducted similarly as in Example 1 gave good results.

EXAMPLE 3

Example 1 was repeated, except that NO gas from the bomb 3 was introduced as the reaction gas in addition to $SiH_4$ gas and $B_2H_6$ gas while being controlled in flow amount by the flow controlling valve 7 into the reaction chamber 11 to obtain a microcrystalline silicon layer containing nitrogen and oxygen. Evaluation of the product conducted similarly as in Example 1 gave good results.

EXAMPLE 4

Figure 4:
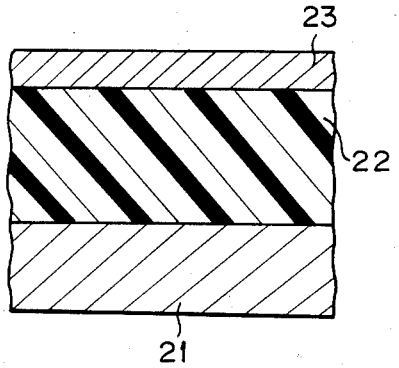
FIG. 4 is a longitudinal sectional view of the electrophotographic photosensitive member prepared in Example 4.

After formation of the microcrystalline silicon layer similarly as in Example 1, $SiH_4$ gas from the bomb 1 and $NH_3$ (ammonia gas) from the bomb 2 were introduced into the reaction chamber 11, and the high frequency power source was turned on to effect glow discharging at an output of 1 KW thereby to form a silicon nitride film on the surface of the silicon layer. The silicon nitride film was thereby formed at a rate of 0.1 μm/min. for 10 minutes to a thickness of 1 μm. Such a film was intended for prevention of reflection of light against the silicon surface simultaneously with protection of the surface of silicon and such a structure contributed much to further enhancement of reliability as the electrophotographic photosensitive member. FIG. 4 shows a longitudinal sectional of this structure, wherein 21 shows a substrate, 22 a microcrystalline silicon layer and 23 a protective film.

EXAMPLE 5

Example 2 was repeated, except that in this Example $PH_3$ gas from the bomb 2 was introduced, following otherwise the same procedures to form a n-type microcrystalline silicon layer. The product was to exhibit good evaluation results, although different from those of Example 2 in characteristics.

EXAMPLE 6

An aluminum substrate of a diameter of 50 mm and a thickness of 1 mm was mounted on a heated supporting member in a deposition device. The deposition tank was once brought to a reduced pressure of $2\times10^{-7}$ Torr, and then the pressure was maintained at 0.4 Torr by a gas mixture of silane ($SiH_4$)/hydrogen (containing 15 vol. % silane). With the temperature of the aluminum substrate being elevated to 200° C., a high frequency voltage of 13.56 MHz was applied to excite glow discharging to form an amorphous silicon layer on the aluminum substrate. The film forming rate was thereby controlled at about 7 Å/sec to give an amorphous silicon layer with a thickness of about 12 μm.

Then, the aluminum substrate was cooled gradually and left to stand at room temperature and flow amount of the silane/hydrogen gas mixture was increased to 5 times, i.e., 100 cc/min.

Glow discharging was also excited again by increasing the high frequency glow discharge power to 100 W thereby to form a microcrystalline silicon layer on the amorphous silicon layer. The film forming rate was about 30 Å/sec, thus giving a microcrystalline silicon layer with a thickness of about 3 μm layered on the amorphous silicon layer, to prepare an electrophotographic photosensitive member.

Said photosensitive member was negatively charged by corona discharging of −6.0 KV for 10 seconds, left to stand in a dark place for 5 seconds and its surface potential at that time was measured. Then, the photosensitive member was exposed to a light of 850 nm from a 300 W xenon light source monochromated with an interference filter, and the time T1/2 before the surface potential was reduced to half of its value was determined. As the result, the electrophotographic photosensitive member according to the present invention was found to exhibit a T1/2 value of 7.0 sec, while that of the photosensitive member of a single amorphous silicon layer was so large as T1/2=15.0 sec.

EXAMPLE 7

A glass plate (100×100×1 mm) coated with an ITO film which is a transparent electrode was set on the cathode of a reactive sputtering device. On the other hand, after a 5-nines' purity silicon crystal was fixed on the target electrode, the deposition tank was reduced to a pressure of $8\times10^{-7}$ Torr by vaccum evacuation. Using a gas mixture of hydrogen and argon (containing 20 vol % of hydrogen), the gas pressure was adjusted to $2\times10^{-2}$ Torr. While heating the glass substrate to be maintained at 40° C., a high frequency voltage of 13.56 MHz was applied to effect sputtering. The deposition speed was markedly so high as 100 Å/sec to obtain a microcrystalline silicon layer with a film thickness of 5 μm. Application of the high frequency voltage was discontinued for intermission, and after the glass temperature was elevated to 200° C., sputtering was practiced again by reducing the flow amount of the gas mixture to half of the previous operation to control the deposition speed to 8 Å/sec, thus providing an amorphous silicon layer on the microcrystalline silicon layer. The amorphous layer had a film thickness of 15 μm.

Said electrophotographic photosensitive member was subjected to corona discharging of +6.0 KV, followed by exposure of the monochromatic light of 850 nm similarly as used in Example 6. As the result, a high photosensitivity with T1/2=6.0 sec was observed.

As apparently seen from the foregoing detailed description of the present invention, by providing an amorphous silicon layer and a microcrystalline silicon layer layered on each other, not only the production speed of an electrophotographic photosensitive member can be accelerated, but also there can be obtained a noticeable sensitizing effect in the long wavelength region (850 nm) to which a single amorphous silicon layer is poor in photosensitivity.

What is claimed is:

1. An electrophotographic photosensitive member, which comprises an electroconductive supporting substrate and a photoconductive layer provided on said supporting substrate, wherein said photoconductive layer consists essentially of a crystalline silicon having a specific dark resistance greater than $10^6$ ohm cm, said crystalline silicon being produced by a glow discharge method under the following conditions:

supporting substrate temperature: 300°–350° C.;
powder density: 0.5–5 W/cm$^2$; and
pressure: 0.01–10 Torr, using hydrogen as a carrier gas.

2. An electrophotographic photosensitive member according to claim 1, wherein said photosensitive member further comprises a layer comprised of amorphous silicon disposed on said photoconductive layer.

3. An electrophotographic photosensitive member according to claim 2, wherein said photoconductive layer is adjacent to said supporting substrate.

4. An electrophotographic photosensitive member according to claim 2, wherein said layer comprised of amorphous silicon layer is adjacent to said supporting substrate.

5. An electrophotographic photosensitive member according to claim 1 or claim 2, wherein the photoconductive layer is doped with 5 to 30 atomic % of hydrogen.

6. An electrophotographic photosensitive member according to claim 1 or claim 2, wherein at least one from the group consisting of oxygen, nitrogen and carbon is doped in the photoconductive layer.

7. An electrophotographic photosensitive member according to claim 6, wherein the doping amount of at least one kind of oxygen, nitrogen and carbon is $10^{-4}$ to $10^{-3}$ atomic %.

8. An electrophotographic photosensitive member according to claim 1 or claim 2, wherein an element of the Group III A of the periodic table is doped as a dopant in the photoconductive layer.

9. An electrophotographic photosensitive member according to claim 8, wherein the doping amount of an element of the Group III A of the periodic table is $10^{-6}$ to $10^{-4}$ atomic %.

10. An electrophotographic photosensitive member according to claim 1 or claim 2, wherein an element of the Group V A of the periodic table is doped as a dopant in the photoconductive layer.

11. An electrophotographic photosensitive member according to claim 10, wherein the doping amount of an element of the Group V A in the photoconductive layer is $10^{-5}$ to $10^{-2}$ atomic %.

12. An electrophotographic photosensitive member according to claim 1 or claim 2, having further a surface protective layer on the photoconductive layer.

13. An electrophotographic photosensitive member according to claim 1 or claim 2, further having a reflection prevention layer on the photoconductive layer.

14. An electrophotographic photosensitive member, which comprises an electroconductive supporting substrate and a photoconductive layer wherein said photoconductive layer consists essentially of silicon having a crystal diffraction pattern at 27°.

15. An electrophotographic photosensitive member, which comprises an electroconductive supporting substrate and a photoconductive layer wherein said photoconductive layer consists essentially of silicon having microcrystals with particle sizes of several 10 angstroms.

16. An electrophotographic photosensitive member according to claim 3, wherein the ratio of the thickness of said lower layer to the thickness of said upper layer is about 0.01–0.5 to 1.

17. An electrophotographic photosensitive member according to claim 16, wherein said ratio is about 0.1–0.5 to 1.

18. An electrophotographic photosensitive member according to claim 2, wherein said supporting substrate temperature is 320°–350° C., said power density is 0.5–5 $W/cm^2$, and said pressure is 0.02–0.2 Torr.

19. An electrophotographic photosensitive member according to claim 4, wherein the ratio of the thickness of said upper layer to the thickness of said lower layer is about 0.01–0.5 to 1.

20. An electrophotographic photosensitive member according to claim 19, wherein said ratio is about 0.1–0.5 to 1.

21. An electrophotographic photosensitive member according to claim 1, wherein said crystalline silicon has a specific dark resistance of $10^{11}$ ohm.cm or more.

* * * * *